United States Patent [19]

Sargentini et al.

[11] 4,027,766

[45] June 7, 1977

[54] INKING DEVICE FOR THE TYPE-CARRIER ELEMENT OF A CALCULATING MACHINE

[75] Inventors: Enrico Sargentini, Turin; Ugo Carena, Ivrea (Turin), both of Italy

[73] Assignee: Ing. C. Olivetti & C., S.p.A., Ivrea (Turin), Italy

[22] Filed: July 8, 1975

[21] Appl. No.: 594,155

[30] Foreign Application Priority Data

July 15, 1974 Italy ..... 69241/74

[52] U.S. Cl. ..... 197/151; 101/108; 101/333; 101/359; 101/336; 197/150; 197/170

[51] Int. Cl.[2] ..... B41J 35/02; B41J 35/26

[58] Field of Search ..... 197/150, 170, 172, 151; 101/108, 327, 93.17, 93.19, 328, 335, 333, 359, 103, 155, 336

[56] References Cited

UNITED STATES PATENTS

| | | | |
|---|---|---|---|
| 2,041,740 | 5/1936 | Beckman | 197/171 |
| 2,675,108 | 4/1954 | Ruderfer | 101/93.19 |
| 2,987,993 | 6/1961 | Giori | 101/155 |
| 3,418,934 | 12/1968 | Pannier | 101/335 |
| 3,526,309 | 9/1970 | Marion et al. | 197/150 |
| 3,578,136 | 5/1971 | Postal | 197/150 |
| 3,654,863 | 4/1972 | Hill et al. | 101/335 |
| 3,669,237 | 6/1972 | Wagner | 101/93.19 |
| 3,678,848 | 7/1972 | Roser et al. | 101/327 |
| 3,724,631 | 4/1973 | Kaczens | 101/93.17 |
| 3,898,360 | 8/1975 | Neumann et al. | 101/327 |

*Primary Examiner*—Edgar S. Burr
*Assistant Examiner*—William Pieprz
*Attorney, Agent, or Firm*—I. J. Schaefer

[57] ABSTRACT

A device for inking the type-carrier element of a calculating machine or similar office machine. The type-carrier element includes a wheel from the edge of which protrudes corresponding characters. These are selected by a recording support for the rotation of the wheel and define the various writing positions for the movement of the wheel along a line of writing. The device includes a container with an ink-deposit element inside it and which has a long window substantially the same length as the line of writing and covered with a permeable, wear-resistant layer which is in contact with the deposit element in order to permit the outflow of the ink. A spring element keeps the said permeable layer tight against the type-carrier element during the rotation and movement of the wheel.

6 Claims, 4 Drawing Figures

INKING DEVICE FOR THE TYPE-CARRIER ELEMENT OF A CALCULATING MACHINE

BACKGROUND OF THE INVENTION

The present invention relates to an inking device for the type-carrier element of a calculating machine or a similar office machine.

An inking device is known in which the inking roller has the length of a complete line of writing and is arranged parallel to the axis of the type-carrier wheel so as to be in constant contact with the latter. In this device, the inking roller consists of a central hub covered with spongy material soaked or impregnated with ink, and is made to rotate by the type-carrier wheel during its rotation for the selection of characters.

This device is, however, extremely expensive and of short life due to the very hard wear to which the spongy material is subjected, both because of the continuous rubbing of the type-carrier wheel on the inking roller during the axial shifting of the wheel along the writing line and because of the necessity to assure the uniform inking of the type-carrier wheel during the life of the roller.

Another device is known in which a length of ribbon made of fabric having the same length as the writing line and which is placed between the type-carrier element and the recording support. It has a part lodged within a container in contact with a piece of felt saturated with ink so that the ribbon is kept constantly inked through capillary action.

This device is, however, unreliable and of limited life since the ribbon is subjected to the strokes of the type-carrier element during the writing phase.

SUMMARY OF THE INVENTION

The main object of the present invention is to provide an inking device for a writing element of a calculating machine which is reliable, inexpensive, of relatively extensive life duration, and easily replaceable when worn out.

According to the invention, a type-carrier element includes a wheel from the edge of which protrude corresponding characters, which are selected according to a recording support for the rotation of the wheel, and which define the various writing positions for the movement of the wheel along the writing line. The device includes a container inside which there is an ink deposit element, and wherein the container has a window substantially of the same length as the writing line and covered with a highly wear-resistant permeable layer in contact with the ink-deposit element in order to permit the outflow of ink. A spring element holds the permeable layer against the type-carrier element during the rotation and the shifting of the wheel.

Having in mind the above and other objects that will be obvious from an understanding of the disclosure, the present invention comprises a combination and arrangement of parts illustrated in the presently preferred embodiment of the invention which are hereinafter set forth in sufficient detail to enable those persons skilled in the art to clearly understand the function, operation, construction and advantages of it when read in conjunction with the accompanying drawings.

DESCRIPTION OF THE PREFERRED EMBODIMENTS

Figure 1:
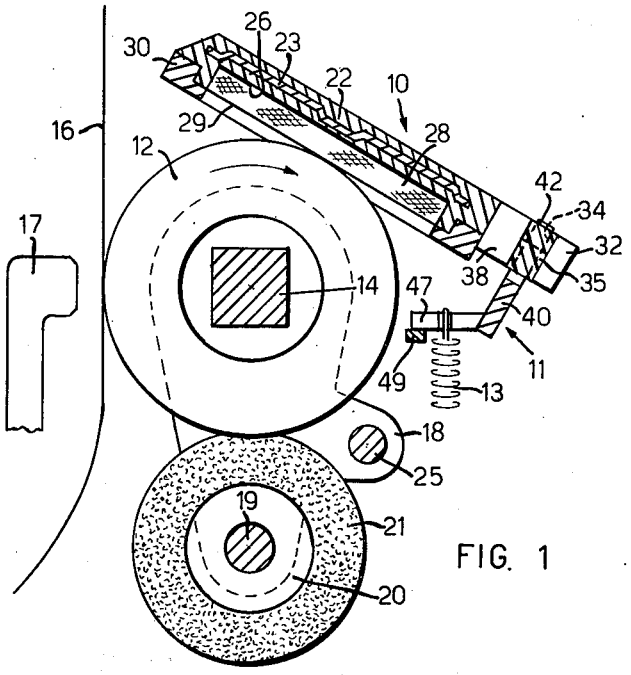
FIG. 1 is a lateral view; partially in section, of a device according to the invention.

With reference to FIG. 1, the device according to the invention includes an inking pad 10 removably mounted onto a support 11, and held against a type-carrier wheel 12 by the action of a spring 13.

Figure 2:
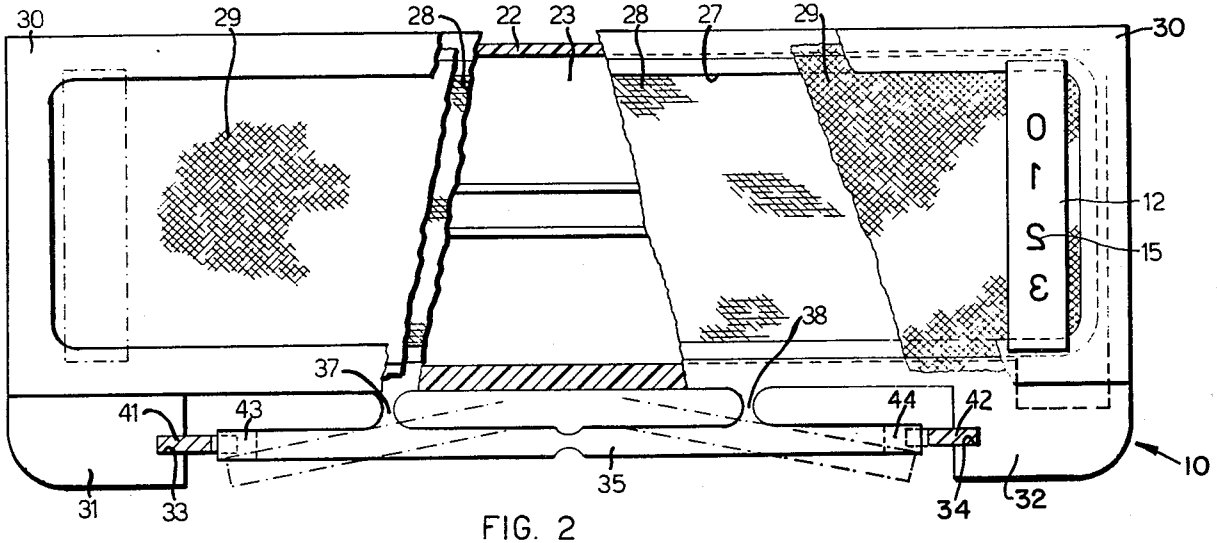
FIG. 2 is an underneath view, partially in section, of the device according to the invention.

The edge of the wheel 12 carries a number of type characters 15 (FIG. 2) and is mounted on a shaft which is square in section (FIG. 1) and which is rotated in any known way in order to achieve the selective positioning of the characters in front of a sheet of paper 16. A type bar 17, located on the opposite side of the paper 16 to that of one wheel 12, is activated in a known way in order to press the character in position onto the sheet of paper 16 and thus effect printing.

The wheel 12, together with the bar 17 may shift transversely across the paper 16 along an entire line of writing, through the action of known means, not shown in the drawings, mounted on a carriage 18 which slides along a shift 25.

The carriage 18 has a pivot 19, parallel to the shaft 14 on which is mounted a small revolving wheel 20, the edge of which is covered with spongy material 21, for example rubber, and which is constantly in contact with the type characters of the wheel 12.

Figure 3:
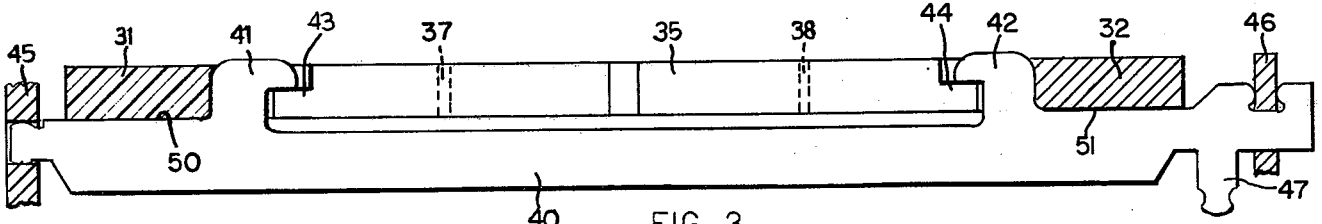
FIG. 3 is a back view, partially in section, of the device according to the invention.

The wheel 20 is rotatably moved by the type-carrier wheel 12, and follows it during its axial movements along the shaft 14. The inking pad 10 includes a container 22 of plastic material, substantially parallelapiped in form (see also FIGS. 2 and 3), inside which a metal tongue 23 is sunk, for additional regidity.

The container 22 includes a space 26 with a window 27 where the ink soaked felt 28 is normally housed. The window 27 is covered by a permeable layer 29 of a substance highly resistant to wear, e.g. strong nylon.

The window 27 is slightly longer than the path of the type-carrier wheel 12 along the writing line.

A frame of plastic material is fixed around the window 27 in order to hold the material 29 taut and in order to attach it, in any known manner, to the container 22.

The container 22 is additionally equipped with two lateral tongues 31 and 32, on each of which is placed a notch 33 and 34, respectively.

A flexible cross-bar 35 is located between the tongues 31 and 32 and is connected to the body of the container 22 by two ribs 37 and 38. The cross-bar 35 has two lateral ends 43 and 44 placed near the notches 33 and 34 of the lugs 31 and 32.

The support 11 on which the inking pad 10 is mounted, includes a tongue 40 (FIG. 3) which is substantially horizontal and above which are two hooks 41 and 42, able to cooperate with the notches 33 and 34 of the lugs 31 and 32, and with the lateral ends 43 and 44 of the cross-bar 35.

The tongue 40 is additionally equipped with two supporting levels 50 and 51 on which the lugs 31 and 32 of the container 23 normally rest. The tongue 40 is pivoted on two sides 45 and 46 of the machine, and has an appendage 47 onto which the spring 13 is hooked. This gives the container 22 the impulse necessary to keep it pressed against the type-carrier wheel 12. A flexed stop 49 is able to cooperate with the appendage 47 in order to limit the rotation of the tongue 40 itself.

The mounting of the pad 10 onto the support 11 occurs as follows. The pad 10 is placed with the window 27 turned towards the type-carrier wheel 12, and with the notches 33 and 34 in correspondence with the hooks 41 and 42 respectively. Light manual pressure applied to the central part of the cross-bar 35 causes it to flex, and pivot on the ribs 37 and 38, causing the lateral ends 43 and 44 to move towards the outside (position outlined in FIG. 2). Thus the two hooks 41 and 42 can lodge in the notches 33 and 34 respectively, and the container 22 with its two lugs 31 and 32 can rest on the supporting levels 50 and 51 respectively of the tongue 40.

The flexible cross-bar 35 is then released and because of its elasticity returns to the rest position, causing its ends 43 and 44 to cooperate with the hooks 41 and 42 respectively (FIG. 3), thus locking the pad 10 onto the support 11.

When the pad is mounted, the type-carrier 12 revolving for example, in a clockwise direction (FIG. 1) in order to select the characters for the sheet of paper 16, causes the same characters 15 to come into contact with the material 29, thus covering them with ink. In this manner before arriving in front of the sheet of paper 16, the characters 15 thus inked come into contact with the spongy roller 21 which removes the excess ink. The printing thus obtained in much neater and without smears. Inking conditions moreover remain unchanged during the axial movement of the type-carrier wheel 12 along the shaft 14, since the window 27 is slightly longer than the writing line. When the ink runs out or when it is required to reach the type-carrier wheel beneath it, the pad 10 may be easily removed by hand by the operator without the help of any particular equipment.

Figure 4:
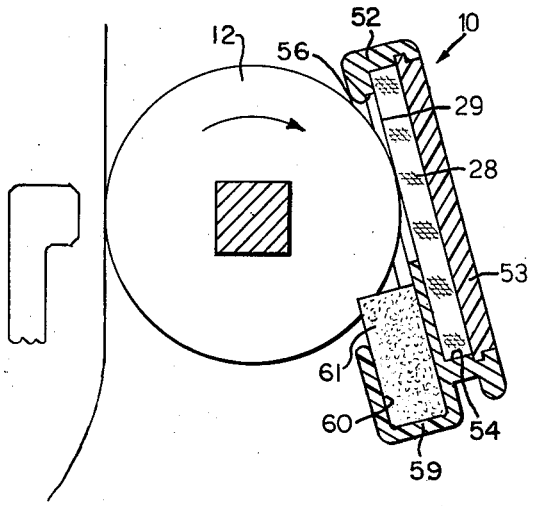
FIG. 4 is a lateral view, partially in section, of a variation on the device according to the invention.

The removal of the pad 10 takes place as follows. By exerting slight manual pressure on the central part of the cross-bar 35, this bends, thus causing the ends 43 and 44 to disengage from the hooks 41 and 42. In this condition the pad 10 can be easily removed by slipping it out upwards. In a variation of the inking device description here a pad 10 (FIG. 4) includes a container 52 of plastic material which has a space 54 inside it which normally accommodates the ink soaked felt 28. A cover 53, also in plastic, is provided to cover the space 54.

The permeable nylon material 29 is fixed in correspondence with a window 56 of the space 54, and is kept in constant contact with the type-carrier wheel 12 due to the action of spring elements not shown in the drawings.

The container 52 has a lower appendage 59 shaped so as to define a cavity 60 containing the spongy material 61, i.e. rubber, which is normally in contact with the characters 15 located on the edge of the wheel 12.

Thus while maintaining the inking conditions unchanged, the excess ink from the container 52 is kept away by the material 61, instead of by the roller 20 which, in this version, can be eliminated.

Moreover, in both versions, when the ink in the pad begins to run out the spongy material 21 or 61 which will be soaked by the excess ink collected by the wheel 12, may continue to deposit ink on the characters 15 for a certain amount of time, thus prolonging the life of the device.

It is evident that modifications or additions may be made to this device without going outside the sphere of this invention and while preferred embodiments of the invention have been shown by way of example in the drawings, it will be understood that the invention is in no way limited to these embodiments.

What is claimed is:

1. A device for inking the type-carrier element of a calculating machine or similar office machine of the type in which the type-carrier element includes a wheel having an edge with protruding characters and support means for effecting the rotation of said wheel to select a desired character and for effecting the movement of said wheel along a printing line to define the various writing positions of said wheel, the device comprising:

a container having a long window substantially the same length as the printing line;

an ink deposit element in the container;

a permeable, wear-resistant layer covering the ink deposit element at the window and in contact with the deposit element to permit the outflow of the ink;

a spring element for biasing said permeable layer tight against the type-carrier element during the rotation and movement of the wheel;

a support member connected to the office machine:

mounting means for removably mounting said container to said support member, said mounting means comprising stationary hooking means for hooking on said support and movable hooking means for hooking on said container and movable with respect to and into engagement with the stationary hooking means, wherein said stationary hooking means includes a pair of hooks and wherein said movable hooking means includes a flexible cross-bar having two ends each cooperative with one of said pair of hooks and means connecting the cross-bar to said container including intermediate ribs.

2. A device according to claim 1, wherein said spring element constantly holds said permeable layer tight against the protruding characters of the type-carrier element during rotation and movement of the wheel, thereby inking said protruding characters without wearing said ink deposit element.

3. A device according to claim 1, wherein said permeable layer includes nylon material and said deposit element includes highly absorbent felt.

4. A device according to claim 3, further comprising a frame fixed around said window to hold said nylon material uniformly taut.

5. A device according to claim 1, further comprising a spongy element mounted to contact said type-carrier wheel to collect the excess ink thereon before the inked character contacts the paper.

6. A device according to claim 5, wherein said spongy element is disposed parallel to the window.

* * * * *